US006779369B2

(12) United States Patent
Shepherd

(10) Patent No.: US 6,779,369 B2
(45) Date of Patent: Aug. 24, 2004

(54) WEFT KNITTED SPACER FABRICS

(75) Inventor: Adrian M. Shepherd, Leicestershire (GB)

(73) Assignee: Monarch Knitting Machinery Corp., Bronx, NY (US)

( * ) Notice: Subject to any disclaimer, the term of this patent is extended or adjusted under 35 U.S.C. 154(b) by 0 days.

(21) Appl. No.: 10/632,140

(22) Filed: Jul. 31, 2003

(65) Prior Publication Data

US 2004/0099016 A1 May 27, 2004

(30) Foreign Application Priority Data

Aug. 30, 2002 (GB) ..... 0220181

(51) Int. Cl.[7] ..... D04B 7/04
(52) U.S. Cl. ..... 66/196; 66/193
(58) Field of Search ..... 66/193, 195, 196, 66/202, 8; 442/318

(56) References Cited

U.S. PATENT DOCUMENTS 2,067,739 A 1/1937 Tanski
5,395,684 A * 3/1995 Robinson et al. ..... 442/312
5,422,153 A * 6/1995 Miyamoto ..... 66/196
5,651,847 A * 7/1997 Loeffler ..... 66/19
5,735,145 A 4/1998 Pernick
5,896,758 A * 4/1999 Rock et al. ..... 66/191
6,105,401 A * 8/2000 Chadeyron et al. ..... 66/195
6,634,190 B2 10/2003 Didier-Laurent

FOREIGN PATENT DOCUMENTS

EP 0 591 987 A1 4/1994
EP 0 630 997 A1 12/1994
EP 0 697 478 A1 2/1996
EP 1 348 788 A1 10/2003
GB 1 355 351 6/1974

* cited by examiner

*Primary Examiner*—Danny Worrell
(74) *Attorney, Agent, or Firm*—Alston & Bird LLP

(57) ABSTRACT

A jacquard pattern, weft knitted spacer fabric is knitted on a double jersey circular knitting machine having a rotatable needle cylinder and needle dial. The cylinder and dial of the machine are adjusted to knit in an interlock gating mode in which the cylinder and dial needles reciprocate between welt, tuck and knit positions respectively in substantially common planes. A jacquard pattern layer is weft knitted on the needle cylinder, a plain layer is weft knitting on the needle dial, and the two layers are coupled together with spacer yarn connected in each layer on alternate needles of the cylinder or dial, as the case may be, traveling to the tuck position for capturing the spacer yarn, thereby to hook the spacer yarn about the necks of cooperating stitches of the weft knitted layers.

8 Claims, 4 Drawing Sheets

WEFT KNITTED SPACER FABRICS

BACKGROUND OF THE INVENTION

The present invention relates to weft knitted spacer fabrics and, more particularly, to jacquard pattern weft knitted spacer fabrics knitted on double knit or jersey circular knitting machines, and methods of knitting such fabrics.

Weft knitted spacer fabrics include two knitted layers, that is, a front or face weft knitted layer and a back weft knitted layer, disposed in spaced relationship and coupled together by a network of spacer or distance yarns. The spacer yarns are typically firmer and more resilient than the yarns of the face and back layers so that the spacer yarns maintain the spacing between the two weft knitted layers. The resilient nature of the spacer yarns enables the front and back layers to be compressed together and then recover, thereby giving the spacer material resiliency in the thickness direction. Moreover, by knitting the face and back layers with the resilient yarns, the spacer fabric may be given stretch and recovery properties in the longitudinal and lateral directions of the fabric. Such spacer fabrics are used for moldable and non-moldable textile materials in the production of wearing apparel and medical, automotive, household and technical textiles.

Spacer fabrics are knitted on double jersey circular knitting machines having rotatable needle cylinders and needle dials. The cylinder knitting needles are arranged to reciprocate axially in grooves in the periphery of the cylinder between welt, tuck and knit positions and the needles of the dial reciprocate in radial grooves in the latter between welt, tuck and knit positions. When in the knit positions, the heads of the cylinder and dial needles are disposed on the circumference of an imaginary circle about the upper end of the needle cylinder. The cylinder knits the face layer of the spacer fabric and the dial knits the back layer and, at the same time, a spacer yarn is connected into the two layers by the cylinder and dial needles in order to couple the layers together.

A double jersey circular knitting machine may be set up for two different modes of operation in which the positional relationships of the cylinder and dial needles differ. In one mode, referred to as the rib gating position or mode, the cylinder needles and dial needles are alternately arranged such that the paths of travel of the dial needles do not intersect with the paths of travel of the cylinder needles and vice versa. In the other mode of operation, referred to as the interlock gating position or mode, the cylinder and dial needles are arranged with their paths of travel respectively in common planes so that the paths of travel intersect.

Jacquard pattern weft knitted spacer fabrics have hitherto been knitted on double jersey circular knitting machines set up for knitting in the rib gating mode so that the heads of the cylinder needles selected for travel to the knit positions will not collide with the heads of the dial needles also selected for travel to the knit positions and the cylinder and dial needles advance past each other. Needle collision cannot therefore occur in jacquard knitting on a circular knitting machine set up for rib gating.

However, needle collision is a distinct problem when jacquard knitting on a double jersey circular knitting machine set up for interlock gating. Hence, the jacquard knitting of spacer fabrics has been restricted to circular knitting machines set up for rib gating. This has several disadvantages. For example, the fabric compressibility, in the thickness direction, is limited. Also, the spacer yarns tend to push through the cylinder knit jacquard face fabric and the dial knit back layer.

BRIEF SUMMARY OF THE INVENTION

One aspect of the present invention is the provision of a jacquard pattern weft knitted spacer fabric which has improved compressibility and recovery properties and in which the spacer yarn is less visible and there is less possibility of the spacer yarn emerging through either of the weft knitted layers of the fabric.

One aspect of the present invention is the provision of a method of knitting a jacquard pattern weft knitted spacer fabric on a double jersey circular knitting machine having a rotatable needle cylinder and needle dial, with the method including the steps of adjusting the cylinder and dial to knit in an interlock gating mode in which the cylinder and dial needles reciprocate between welt, tuck and knit positions respectively in substantially common planes, weft knitting a jacquard pattern layer on the needle cylinder, weft knitting a plain layer on the needle dial, and coupling the two layers together by a spacer yarn which is connected in each layer on alternate needles of the cylinder or dial, as the case may be, traveling to the tuck position for capturing the spacer yam, thereby to hook the spacer yam about the necks of cooperating stitches of the weft knitted layers.

In accordance with one aspect of the present invention, the resulting jacquard pattern weft knitted spacer fabric may include a jacquard pattern face layer weft knitted on the needle cylinder and a plain back layer weft knitted on the dial, these two layers being mutually spaced apart and coupled together by a network of spacer yarns which are firmer and more resilient than the yarns of the face and back layers. Moreover, the connecting points at which the spacer yarn connects with the weft knitted layers are such that, in opposing courses of the two layers, the connecting points of one layer are substantially centralized between two connecting points of the other layer. The spacer yarn therefore has a more upright stitch formation than spacer fabrics hitherto knitted on double-jersey circular knitting machines set up for rib gating, and this enables thicker spacer fabrics to be produced having better compression, springiness and recovery properties. Such fabric characteristics are particularly important for end uses, such as car seats, office and domestic furniture and mattress tickings.

In accordance with one aspect of the present invention, the spacer yarn is preferably less visible than in spacer fabrics knitted on machines set up for rib gating. This is because the interlock gating knitted structure provides better cover and, therefore, less possibility of the spacer yarns emerging through either the cylinder knitted jacquard face layer or the dial knitted back layer. Hence, the visual and tactile aesthetics of the spacer fabric of the present invention are preferably not impaired by exposure of the spacer yarn.

According to one aspect of the present invention, the stretch and recovery characteristics and properties, moldability, wear abrasion, moisture management, breathability, electrical properties and TOG rating can be specifically engineered to meet the demands of a particular end use. This is achieved by careful selection of the types of yarns and fibers used on the face and back of the fabric, the type and thickness of the spacer or distance yarn, inclusion of a filler or inlay yarn, and also by the inclusion or otherwise of varying percentages of stretch polyester, polyamide and polyurethane yarns, such as the range of elastane yarns marketed under the trade mark "Lycra" by Dupont Textiles and Interiors. The use of stretch polyester, stretch polyamide and polyurethane yarns, such as, Lycra elastane yarns, enables the raised effect of a jacquard pattern to be enhanced as well as the stretch and recovery characteristics of the spacer fabric.

Conveniently, the jacquard pattern weft knitted spacer fabric according to the invention can be produced on a double jersey circular knitting machine of the type described in EP-A-0 591 987 which is adjusted for knitting in the interlock gating mode. Such a circular knitting machine includes a rotating knitting cylinder having axial grooves in its outer periphery with a knitting needle positioned in each groove. The cylinder needles reciprocate upwardly and downwardly in the cylinder grooves between welt, tuck and knit positions under the control of cylinder needle operating cams disposed about the cylinder, in conjunction with intermediate and lower jacks which are disposed in the cylinder grooves beneath the cylinder needles and one below the other. There are two different sets of intermediate and lower jacks disposed in alternate cylinder grooves below the associated cylinder needles. The intermediate jacks of the two sets differ from one another only in the height of the butts thereon which engage cooperating cylinder cams controlling movement of the intermediate jacks. They are referred to as high and low butt intermediate jacks, respectively, in the sense that the butt on one intermediate jack is above the other in relation to the vertical axis of the cylinder. In a similar sense, the lower jacks have armatures of different heights and are referred to as high armature and low armature jacks. The intermediate and lower jacks with the same type of butt or armature, that is high or low, are disposed in the same cylinder groove. The intermediate jacks are reciprocated upwardly and downwardly in the cylinder grooves between bottom, welt and tuck positions by cooperation of their butts with dual race intermediate jack cams. The lower jacks are reciprocated upwardly and downwardly in the cylinder grooves between bottom and welt positions by cooperation of their butts with lower jack cams.

The cylinder needles are controlled via the intermediate and lower jacks, by a needle selection and operating mechanism which selects the cylinder needles for movement from the welt position to the knit or tuck positions for knitting a jacquard pattern. The mechanism includes the lower jack cams for raising selected lower jacks from their bottom positions to the welt positions, and an electronic selection mechanism for selectively moving, into the path of the lower jack cams, the lower jacks in the cylinder grooves containing the cylinder needles selected for movement to the knit or tuck positions so that the selected lower jacks are raised from their bottom positions to the welt position and the selected lower jacks raise the associated corresponding intermediate jacks from their bottom positions to the welt positions. The intermediate jack cams selectively raise, from the welt position to the tuck position, only those intermediate jacks which are below cylinder needles selected for movement to the knit positions. Needle cams are provided for raising to the knit positions cylinder needles raised to the tuck position by the jacks, if the pattern dictates such movement.

Slidably mounted in the dial grooves of the knitting machine, in alternate grooves, are two different types of dial needle having butts in differing positions. These are referred to as high butt and low butt needles in the sense that the high butts are radially outwardly of the low butts. The dial needles are selectively reciprocated in the dial grooves by dual cam tracks which control the two different types of butts of the dial needles selectively to move the dial needles from welt positions to tuck or knit positions or maintain the dial needles in their welt positions.

With the machine construction described in EP-A-0 591 987, even if wrong needle selection is made, as frequently occurs for one reason or another, the lower jacks wrongfully selected can move only from the bottom to the welt position. The intermediate jack cam system includes an upper guard cam and a lower guard cam and an intermediate jack raising cam which is selectable for operation or non-operation position. The intermediate jack raising cam for a wrongfully selected needle will be in the non-operating position and will not engage the butt of the intermediate jack moved upwardly by a wrongfully selected lower jack and will not move the intermediate jack further upwardly beyond the welt position. Similarly, the needle raising cam will not engage the butt of the cylinder needle and will not move the cylinder needle above the welt position. Therefore, needle collision is obviated in this circular knitting machine set-up for interlock gating operation.

When the above-described machine is operated to produce a spacer fabric according to the present invention, at those yarn feeders where the jacquard pattern face layer is produced by the cylinder needles, the individual cylinder needle selection may be varied and combined so as to produce distinctly different visual and aesthetic effects. For example, flat surface jacquard designs can be produced based on individual cylinder needles being selected to either knit or miss. If, however, the cylinder needles are selected in knit and tuck combinations, it is possible to produce jacquard designs having raised surface effects.

BRIEF DESCRIPTION OF THE DRAWINGS

Figure 1:
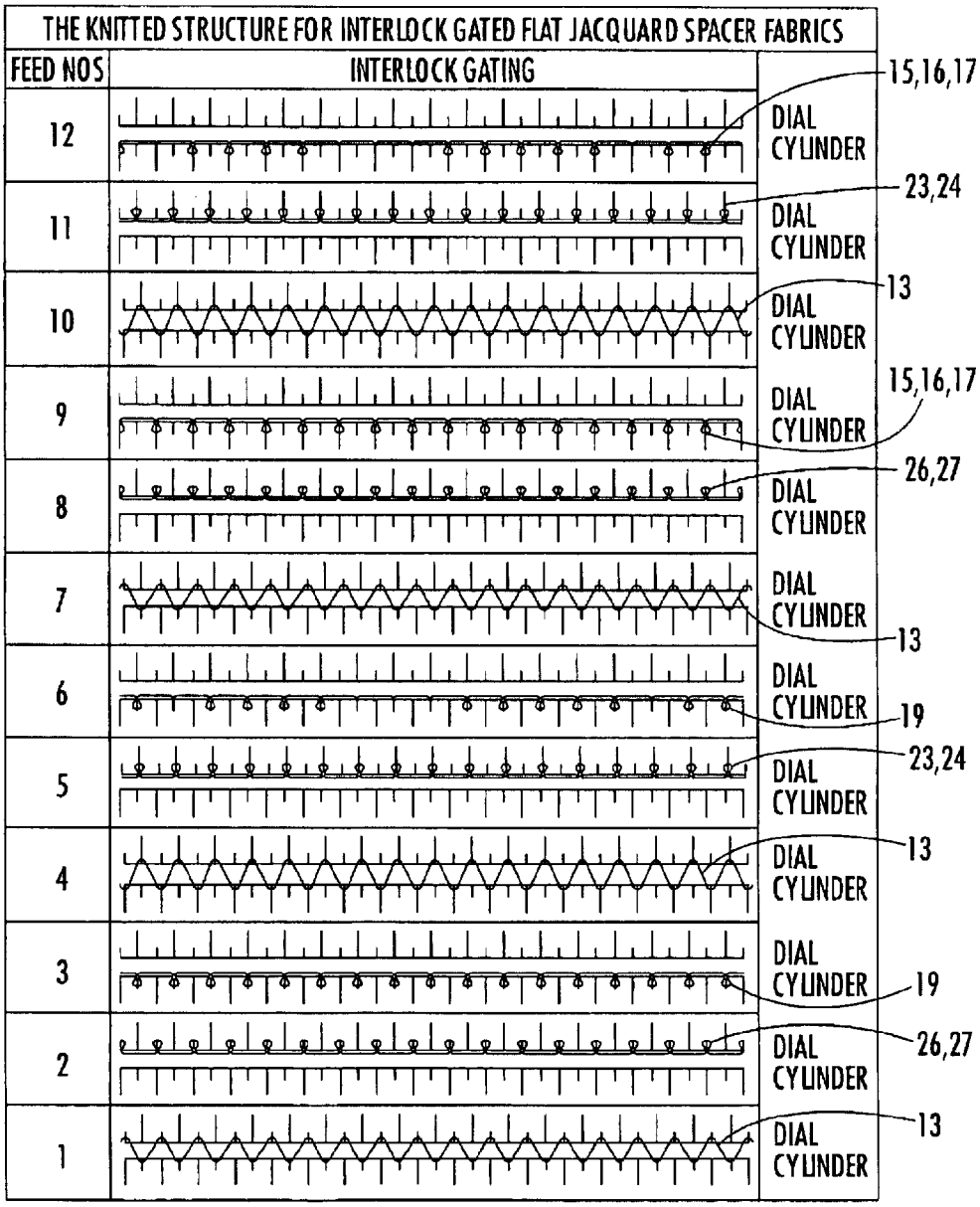
Figure 2:
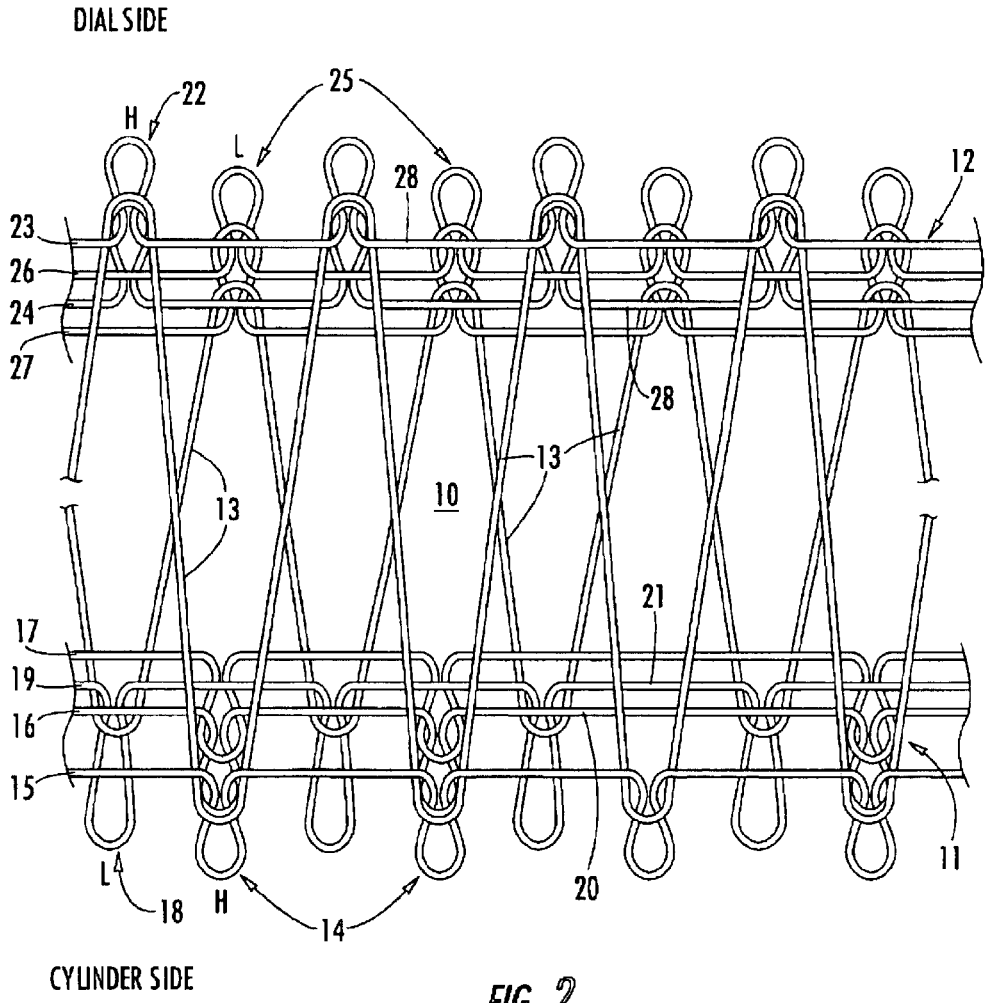
Figure 3:
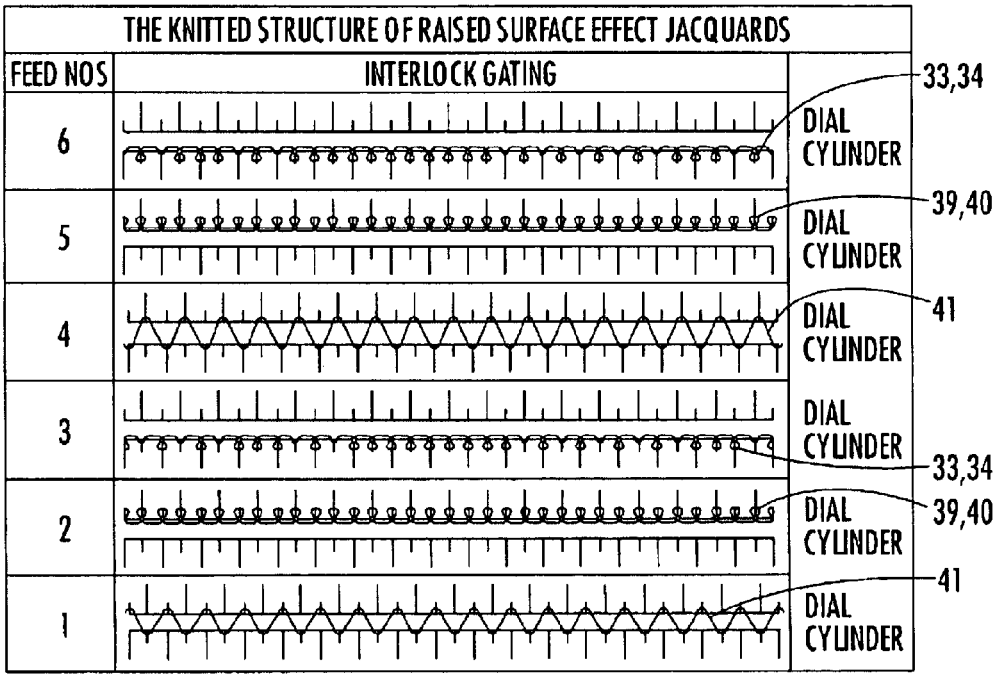
Figure 4:
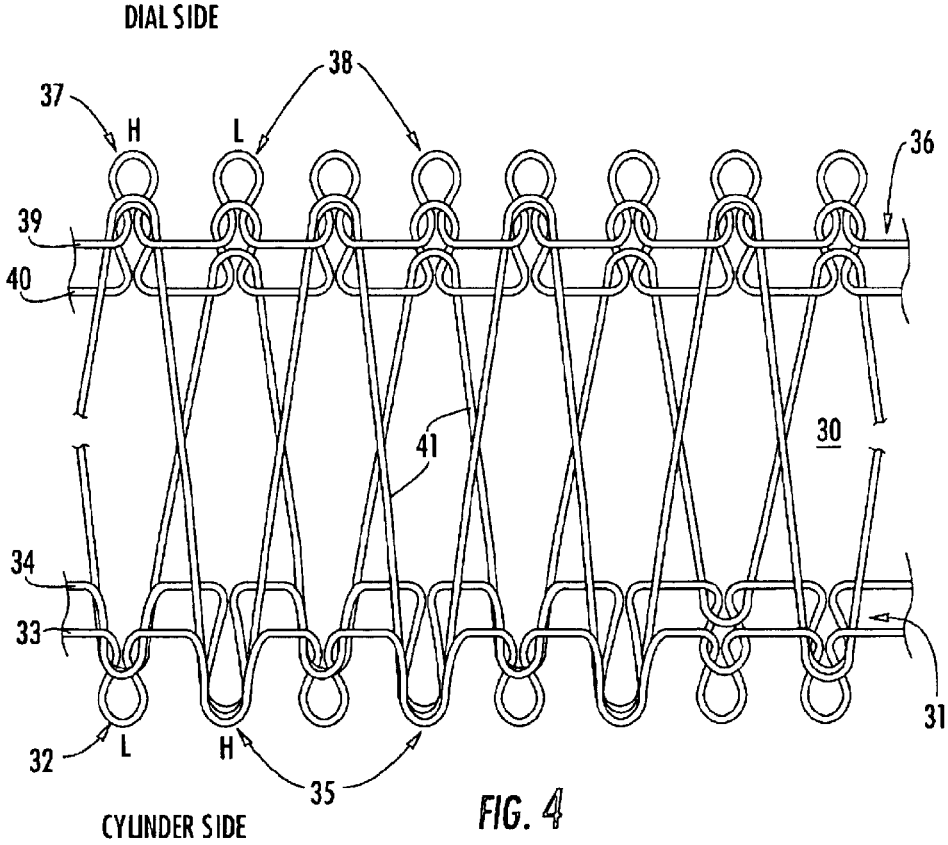

Having thus described the invention in general terms, reference will now be made to the accompanying drawings, which are not necessarily drawn to scale, and wherein:

FIG. 1 is a knitting structure diagram for a flat pattern jacquard spacer fabric according to an embodiment the invention and to be produced on a double jersey circular knitting machine, FIG. 2 is an enlarged schematic sectional view of the jacquard pattern spacer fabric corresponding to the structure diagram of FIG. 1, FIG. 3 is a knitting structure diagram of a jacquard pattern spacer fabric according to an embodiment of the invention, having a raised surface effect jacquard pattern and to be produced on a double jersey circular knitting machine, and FIG. 4 is an enlarged schematic sectional view of the spacer fabric corresponding to the structure diagram of FIG. 3.

DETAILED DESCRIPTION OF THE INVENTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

The jacquard pattern weft knitted spacer fabrics illustrated in the accompanying drawings may be knitted on a double jersey circular knitting machine that is described in the aforementioned EP-A-0 591 987, with that machine operating in an interlock gating mode with the cylinder and dial needles reciprocating between welt, tuck and knit positions respectively in substantially common planes. The cylinder needle selection is controlled by an electronic selection mechanism in conjunction with cylinder cams, while the dial needle selection is controlled by dual cam tracks respectively controlling the low and high butt dial needles. Hereinafter, the cylinder needles will also be referred to as high or low butt needles in accordance with whether their control mechanisms include high butt and armature intermediate and lower jacks or low butt and armature jacks. EP-A-0 591 987 is incorporated herein by reference, in its entirety.

Referring to FIGS. 1 and 2 of the accompanying drawings, the weft knitted flat jacquard spacer fabric 10 includes a weft knitted jacquard pattern front layer 11 and a weft knitted plain back layer 12 disposed parallel to one another at a predetermined spacing and coupled together by a network of spacer yarns 13 which are preferably firmer and more resilient than the yarns of the face and back layers. The weft knitted face layer 11 has wales 14 formed by yarns 15, 16, 17 knitted by the high butt cylinder needles and wales 18 formed by yarns 19 knitted by the low butt cylinder needles. The wales 14 and 18 are alternately arranged, the parts of the layer formed by the yarns 15, 16, 17 of wales 14 and those formed by yarns 19 of wales 18 being coupled together by floating, i.e. non knit, yarn sections 20, 21 to form an integral face layer.

The weft knitted back layer 12 has wales 22 formed by yarns 23, 24 knitted by the high butt dial needles and wales 25 formed by yams 26, 27 identical with the yarns 23, 24 and knitted by the low butt dial needles. Again, the wales 22, 25 are alternately arranged and the parts of the layer formed by the yarns of the wales 22 and those formed by the yams of the wales 25 are coupled together by floating, i.e. non knit, yarns 28 to produce an integral back layer.

The spacer yam 13 coupling the two layers 11, 12 together is connected in each layer by being tucked into each course of the layer by the high butt needles or the low butt needles of the knitting machine. Each spacer yam 13 of one course is hooked, for example, about the neck of the yarn 15 of a wale 14 of the face layer 11 and then about the neck of the yarn 23 of an adjacent wale 22 of the back layer 12 and, in the next course, each spacer yam is hooked about the neck of the yarn 19 of a wale 18 of the face layer and then the neck of the yarn 27 of an adjacent wale 25 of the back layer.

The jacquard pattern produced in the face layer, as will be apparent from the diagram of FIG. 1, is based on a knit and miss selection of the cylinder needles. The knitting diagram of FIG. 1 illustrates the knitting action of the cylinder and dial needles as yarn is fed to the needles from twelve consecutive yam feeding positions 1–12 of the knitting machine. At each feeder, the cylinder and dial needles are represented by alternate long and short vertical lines, the longer lines representing high butt needles and the shorter lines low butt needles. A loop indicates a full knitting stroke of a needle with the previous loop being cast off, and a small U-shape hooked about a needle indicates a knitting stroke to the tuck position.

Hence, at feeder 1, the spacer yarn 13 is fed to the needles and is captured by alternate needles of the cylinder and dial, in this case, the low butt needles, selected to travel to the tuck positions. The high butt needles are maintained in their welt positions. At feeder 2, back layer yarn e.g. 26 or 27 is fed to alternate dial needles, which are the low butt needles which have captured the spacer yarn at feeder 1, and these low butt dial needles travel in a full knitting stroke so that the spacer yarn is cast off and hooks about the loop of the yam of the back layer. All the cylinder needles are maintained in their welt positions so that no yarn is knit by the cylinder needles at feeder 2. At feeder 3, conversely to feeder 2, yarn 19 of the face layer is knit by selecting the low butt cylinder needles so that the spacer yarn is hooked about necks of the stitches of the face layer. At feeder 4, spacer yarn 13 is tucked into the face and back layers on alternate dial and cylinder needles moving to the tuck positions, in this case, the high butt needles. Thereafter, at feeder 5, yarn e.g. 23, 24 of the back layer is knitted by selecting the high butt dial needles which travel in a knitting stroke to the knitting positions and the cylinder needles are maintained in the welt positions. The yarn 19 supplied via feeder 6 is knit solely by the cylinder needles and only selected low butt needles knit the yarn supplied at this position in accordance with the needle selection produced by the electronic needle selection mechanism, whereby to produce a course of the jacquard pattern of the face layer. The cylinder needles not used to knit the yarn 19 supplied at feeder 6 are maintained in the welt positions and the yarn is floated past these needles to the next cylinder needle traveling to the knit position to pick up the yarn. The dial needles are maintained in the welt positions at feeder 6 so that there is no knitting of stitches for the back layer at feeder 6. Subsequently, the needles are rotated through successive yarn feeding positions 7 to 12, and knitting is continued, using the predetermined needle selection pattern, to produce the spacer fabric of FIG. 2.

FIGS. 3 and 4 illustrate a weft knitted spacer fabric 30 having a raised surface effect jacquard pattern and knitted by a double jersey circular knitting machine of the construction described in EP-A-0 591 987. The latter operates in the interlocked gating mode and the jacquard pattern is produced based on a knit and tuck selection of the cylinder needles. The jacquard pattern weft knitted face layer 31 produced on the needle cylinder comprises wales 32 formed by yarns 33, 34 being selected by the low butt cylinder needles and wales 35 also formed by the yarns 33, 34 selected by the high butt cylinder needles. Hence, each course of the weft knitted face layer is formed by yarns which are knitted into the course by the high and low butt needles traveling to either the knit or tuck positions.

The weft knitted back layer 36 has wales 37, 38 knitted by selecting all the dial needles at each yam feeding positions 2 and 5 for the back layer (see FIG. 3), both the high butt and low butt needles reciprocating to the knit positions at each such feeder to pick up yams 39, 40 and produce a stitch loop.

The face and back layers 31, 36 are coupled together by a network of spacer yarns 41 which are connected in each layer by being tucked into the layer by alternate needles, that is, by either selecting the high or low butt needles for each course. The selected needles travel to the tuck positions for capturing the spacer yarns 41 so that the spacer yarn is hooked about the necks of cooperating stitches in alternate wales of the two layers. The stitches of the wales of the jacquard pattern face layer 31, such as wales 35, are formed by high butt needles moving to the tuck position to pick up a tuck loop of the spacer yarn 41 and, at a subsequent feeder, a tuck loop of face layer yarn 33 without casting off the loop of yarn 34 captured at a previous feeder. Only when these same cylinder needles are selected to move to the knit positions to produce knit loops are the previous tuck loops cast off about the new knit loop, with the spacer yarn connected with the necks of the loops captured by the associated cylinder needles.

FIG. 3 illustrates the knitting structure of the raised surface effect jacquard pattern spacer fabric. In this diagram, the same representations indicate the same elements of the knitting structure as in the knitting structure diagram for the previous embodiment. Hence, at feeder 1 spacer yam 41 is captured by the low butt needles of the cylinder and dial being selected to move to the tuck positions. At feeder 2, all dial needles are selected for movement to the knit positions so that the previously captured spacer yarn is cast off and hooks about the neck of a knit loop of yam 39, 40. The cylinder needles are maintained in the welt positions at this feeder. At feeder 3, the cylinder needles are selectively moved by the electronic pattern selection mechanism to the knit or tuck positions to capture knitting yarn 33, 34 of the face layer in accordance with the desired jacquard pattern. The dial needles are maintained in the welt positions. Spacer yam 41 is again tucked into the face and back layers at feeder 4, the spacer yam being captured by alternate needles which, at this feeder, are the high butt needles of the cylinder and dial needles. At feeder 5, the cylinder needles are maintained in the welt positions and all the dial needles are selected to knit the yam 39, 40 supplied at this feeder by moving to the knit positions. At feeder 6, all the cylinder needles are selected by the pattern selection mechanism for movement to either the tuck or knit positions, as determined by the pattern control mechanism, in order to knit the yarn 33, 34 at feeder 6 while the dial needles are maintained in the welt positions. Thereafter, knitting proceeds as the needles rotate through subsequent feeder positions with the jacquard pattern control mechanism controlling the selection of the cylinder needles in order to produce the spacer fabric 30 with a face layer 31 having a predetermined jacquard pattern.

In both the above embodiments, the connecting points at which the spacer yarn 13, 41 connects with the weft knitted face and back layers are such that, in opposing courses of the two layers, the connecting points of the face layer are substantially centralized between two connecting points of the back layer and vice versa. The spacer yam therefore has an upright stitch formation which provides better compression, springiness and recovery properties. Moreover, the face and back layers may be knit with stretch polyester, polyamide and polyurethane yarns such as the elastane yarns marketed under the trade mark "Lycra". The spacer yarns of both embodiments may, for example, be a monofilament of polyester yarn which is more firm than the yarns used for knitting the face and back layers so as to maintain these spaced apart and this again assists in providing good compressibility and recovery characteristics.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A method of knitting a jacquard pattern, weft knitted spacer fabric on a double jersey circular knitting machine having a rotatable needle cylinder and a rotatable needle dial, the method comprising:

knitting the jacquard pattern, weft knitted spacer fabric on the double jersey circular knitting machine by operating the double jersey circular knitting machine in an interlock gating mode so that cylinder needles carried by the needle cylinder and dial needles carried by the needle dial reciprocate between welt, tuck and knit positions respectively in substantially common planes, with the knitting including:

weft knitting a jacquard pattern layer of the weft knitted spacer fabric on the needle cylinder, weft knitting a second layer of the weft knitted spacer fabric on the needle dial, and coupling the jacquard pattern layer and the second layer to one another with spacer yarn, with the coupling including:

repeatedly connecting the spacer yarn in the jacquard pattern layer by hooking the spacer yarn about necks of stitches of the jacquard pattern layer, wherein hooking the spacer yarn about necks of stitches of the jacquard pattern layer includes moving alternate needles of the cylinder needles to the tuck position, so that for each needle of the alternate needles of the cylinder needles moved to the tuck position, the needle captures the spacer yarn, and repeatedly connecting the spacer yarn in the second layer by hooking the spacer yarn about necks of stitches of the second layer, wherein hooking the spacer yarn about necks of stitches of the second layer includes moving alternate needles of the dial needles to the tuck position, so that for each needle of the alternate needles of the dial needles moved to the tuck position, the needle captures the spacer yarn.

2. A method according to claim 1, further comprising adjusting one or more of the needle dial and the needle cylinder to transition the double jersey circular knitting machine from a rib gating mode to the interlock gating mode, prior to knitting the jacquard pattern, weft knitted spacer fabric on the double jersey circular knitting machine.

3. A method according to claim 1, wherein weft knitting the second layer of the weft knitted spacer fabric is carried out so that the second layer of the weft knitted spacer fabric is a plain layer of the weft knitted spacer fabric.

4. A method according to claim 1, further comprising selecting the spacer yam and yarns of the jacquard pattern layer and the second layer so that the spacer yam is firmer and more resilient than the yarns of the jacquard pattern layer and the second layer.

5. A jacquard pattern, weft knitted spacer fabric, comprising:

a spacer yarn repeatedly connected to each of a weft knitted jacquard pattern layer of the spacer fabric and a weft knitted second layer of the spacer fabric, so that the jacquard pattern layer and the weft knitted layer are connected to one another, wherein:

courses of the second layer are respectively substantially aligned with courses of the jacquard pattern layer, a first side of the second layer and a first side of the jacquard pattern layer face toward one another, the spacer yarn is for seeking to resiliently keep the first side of the jacquard pattern layer and the first side of the second layer spaced apart from one another by a predetermined distance, the spacer yarn repeatedly extends back and forth between the first side of the jacquard pattern layer and the first side of the second layer, for each of a multiplicity of points at which the spacer yarn is connected in the jacquard pattern layer and the second layer:

the spacer yam extends directly from said point to two adjacent points at which the spacer yarn is connected to the other of the jacquard pattern layer and the second layer, and said point is substantially centralized between said two adjacent points.

6. A fabric according to claim 5, wherein the spacer yarn is firmer and more resilient than yams of the jacquard pattern layer and the second layer.

7. A fabric according to claim 5, wherein the spacer yarn is connected in the jacquard pattern layer and the second layer by being respectively hooked about necks of stitches of the jacquard pattern layer and the second layer.

8. A fabric according to claim 5, wherein the second layer is a plain layer.

* * * * *